US006292147B1

(12) United States Patent
Ham

(10) Patent No.: US 6,292,147 B1
(45) **Date of Patent: *Sep. 18, 2001**

(54) SELF-POSITIONING GPS ANTENNA

(76) Inventor: Byung Il Ham, 16550 E. Blackburn Dr., La Mirada, CA (US) 90638

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/611,811

(22) Filed: Jul. 7, 2000

(51) Int. Cl.[7] ..... H01Q 1/24
(52) U.S. Cl. ..... 343/702; 343/882
(58) Field of Search ..... 343/702, 882, 343/900, 888; 455/90

(56) References Cited

U.S. PATENT DOCUMENTS 5,512,912 * 4/1996 Ross et al. ..... 343/765
6,128,515 * 10/2000 Kabler et al. ..... 455/566

* cited by examiner

*Primary Examiner*—Don Wong
*Assistant Examiner*—James Clinger
(74) *Attorney, Agent, or Firm*—Blakely Sokoloff Taylor & Zafman

(57) ABSTRACT

An apparatus is described for maintaining a GPS antenna element at a predetermined orientation. The apparatus includes a holder configured to support the GPS antenna element. The holder is pivotally coupled to a base structure and is configured to pivot with respect to a pivot axis. When the force of gravity is applied to the holder, it causes the GPS antenna element supported by the holder to be maintained at the predetermined orientation even when the base structure to which the holder is coupled changes its orientation. In one embodiment, an extra weight is provided on one side of the holder such that the force of gravity applied to the extra weight will cause the antenna element supported by the holder to be maintained at a predetermined angular orientation.

22 Claims, 5 Drawing Sheets

SELF-POSITIONING GPS ANTENNA

BACKGROUND OF THE INVENTION

1. Field of the Invention

The present invention generally relates to a global positioning system (GPS) antenna, and in particular, to an apparatus for maintaining GPS antenna element at a predetermined angular orientation.

2. Description of the Related Art

In the field of GPS technology, GPS receivers are used to determine its geographic location by receiving microwave radio signals from a group of orbiting GPS satellites. The geographic location of the receiver may be computed by calculating its distance from each satellite by determining how long the signals took to travel from the satellite to the receiver. Typically, a flat GPS antenna element is utilized by GPS receivers to receive signals transmitted from the satellites. In order for the GPS receiver to accurately compute its geographic location, the GPS antenna element must be oriented in such a way as to receive an acceptable level of GPS signals from the satellites.

A variety of portable devices have been proposed for incorporating GPS receiver therein, and are becoming increasingly popular due to the availability of low cost GPS receivers and a wide variety of GPS applications. For example, a GPS receiver may be incorporated into a portable device (e.g., cellular phone, handheld GPS navigation system) to provide various functionality such as to determine its location, to provide navigation information or to remotely provide others with the information about the user's current location. At least in some of the portable devices having a GPS receiver incorporated therein, the GPS antenna is fixedly attached to the portable units.

Such prior art method of fixedly attaching the GPS antennas to the portable unit suffers from various disadvantages. For example, because the intensity level of the signals received by the GPS antenna depends on the angular orientation of the antenna element, the signal level received by the GPS antenna will vary as the orientation of the portable unit changes during operation thereof. As a result, a user of the conventional portable device must manually change the orientation of the device until the GPS antenna is able to receive an acceptable level of GPS signals.

In addition to applications in portable devices, GPS receivers are incorporated into vehicles for general navigational use. At least in some of the GPS receivers associated with vehicles, the GPS antenna is fixedly attached to a stationary part of the vehicles (e.g., windshield, backglass, roof panel). As previously mentioned, if the GPS antenna is fixedly attached to a stationary structure, the intensity level of GPS signals received by the GPS antenna will depend on the orientation of the vehicle. Consequently, as the orientation of the vehicle changes as the vehicle maneuvers up or down a hill, the signals received by the GPS antenna will vary and may fall below an acceptable signal level in certain situations.

SUMMARY OF THE INVENTION

The inventor has recognized that the signal level received by a GPS antenna may be enhanced by maintaining the face of the GPS antenna element at a certain angular orientation. Thus, there is a need to provide a self-positioning GPS antenna that is capable of automatically readjusting its orientation as the base structure to which the antenna is attached becomes tilted in order to maintain the face of the antenna element at a predetermined angular orientation.

The present invention is directed to an apparatus for maintaining a GPS antenna element at a predetermined orientation. The apparatus includes a holder configured to support the GPS antenna element. The holder is pivotally coupled to a base structure and is configured to pivot with respect to a pivot axis. When the force of gravity is applied to the holder, it causes the GPS antenna element supported by the holder to be maintained at the predetermined orientation even when the base structure to which the holder is coupled changes its orientation. In one embodiment, an extra weight is provided on one side of the holder such that the force of gravity applied to the extra weight will cause the antenna element supported by the holder to be maintained at a predetermined angular orientation.

DETAILED DESCRIPTION OF THE INVENTION

Figure 1A:
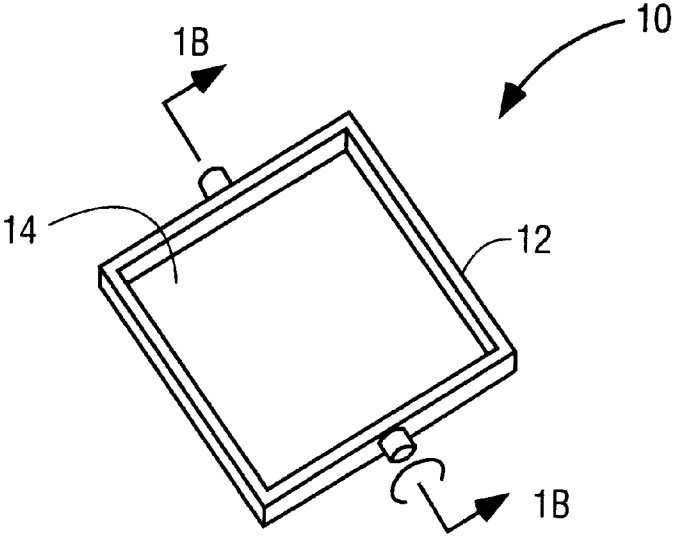
FIG. 1A is a diagrammatic perspective view of an antenna holder in accordance with one embodiment of the present invention.
Figure 1B:
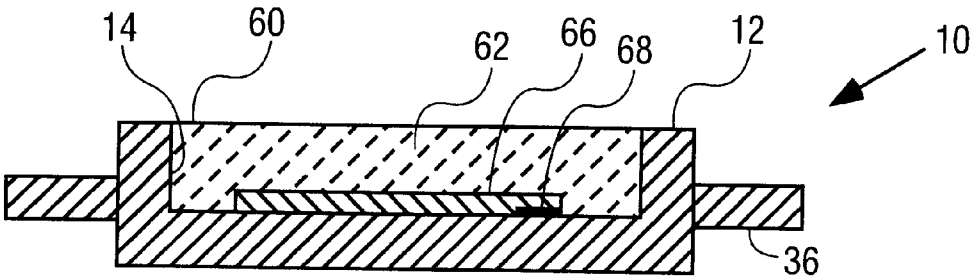
FIG. 1B is a sectional view of the antenna holder and a GPS antenna element supported thereby taken along line 1B—1B of FIG. 1A.

FIG. 1A shows an antenna holder 10 in accordance with one embodiment of the present invention. FIG. 1B shows a sectional view through the antenna holder 10 and a GPS antenna element 60 taken along the section line labeled 1B—1B in FIG. 1A. The GPS antenna element 60 has a flat configuration and is adapted to receive microwave radio transmissions from orbiting GPS satellites. The antenna element 60 includes substantially planar substrate 62 made of a ceramic or other appropriate dielectric material. The lower surface of the dielectric substrate 62 has bonded thereto a grounding conductor 66. The grounding conductor 66 may be electrically coupled to the antenna holder 10 via a soldering 68 or any other suitable methods as would be appreciated by those skilled in the art. In one embodiment, a portion or the entire antenna holder is constructed of an electrically conductive material to provide electrical communication from the antenna element 60 to a cable 46 (FIG. 2) operatively coupled to the holder.

The antenna holder 10 is arranged to support the GPS antenna element 60 and includes a frame 12 having a receiving portion 14 for supporting the GPS antenna element 60. In the illustrated embodiment, the frame 12 is generally of rectangular or square shape having a rectangular or square recess 14 arranged to receive the antenna element 60. During installation of the antenna element into the holder, any suitable engagement means may be employed for supporting the antenna element against disengagement from the receiving portion 14, such as applying adhesive substance between the antenna element and the holder. Because the antenna element is generally small in size (e.g., approximately 1.6 cm square and 5 mm thick), the antenna holder and the antenna element supported thereby are capable of conveniently fitting into a relatively small space.

Figure 2:
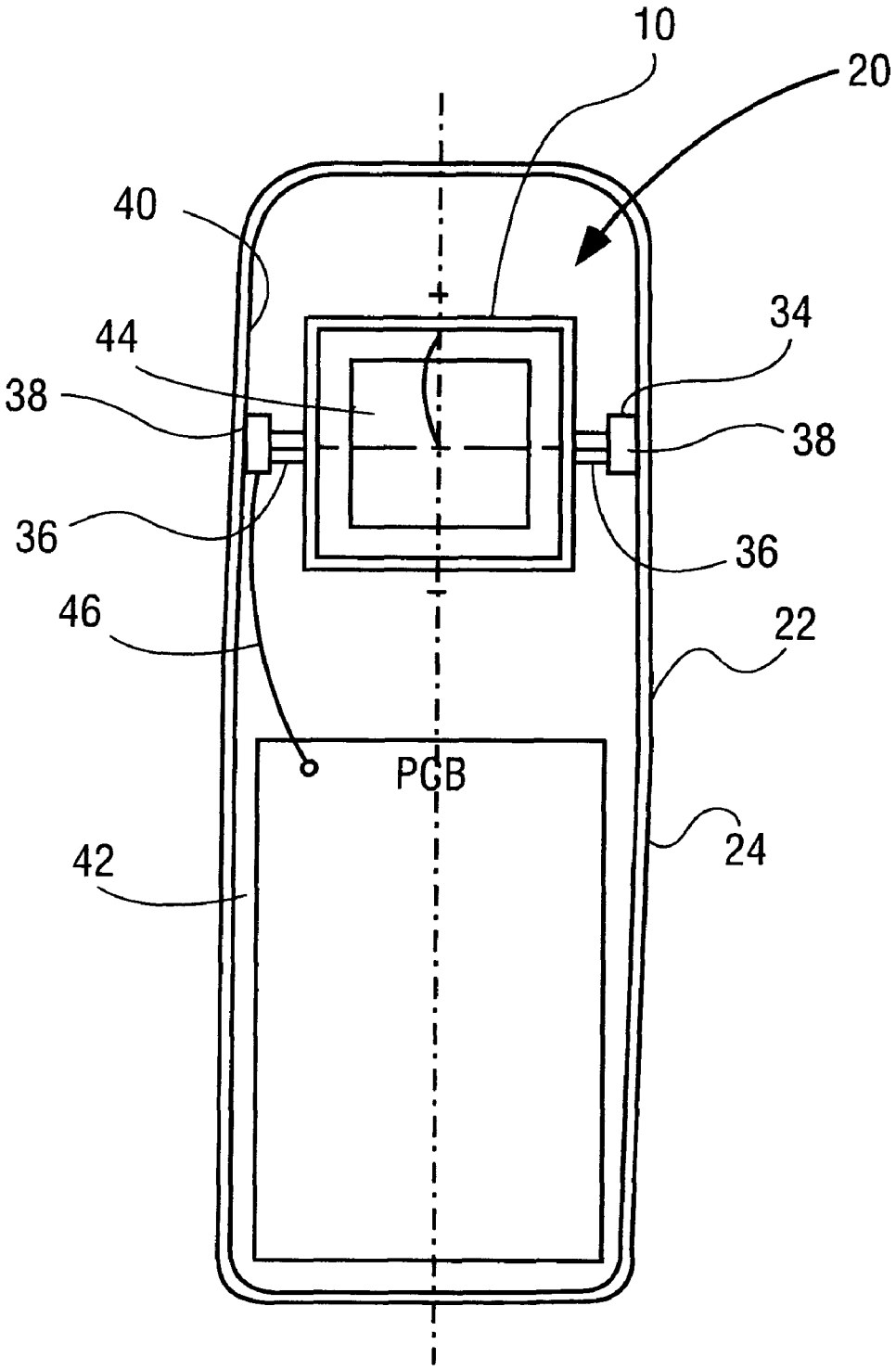
FIG. 2 is a front elevational view of a self-positioning GPS antenna incorporated into a portable device in accordance with the present invention.
Figure 3:
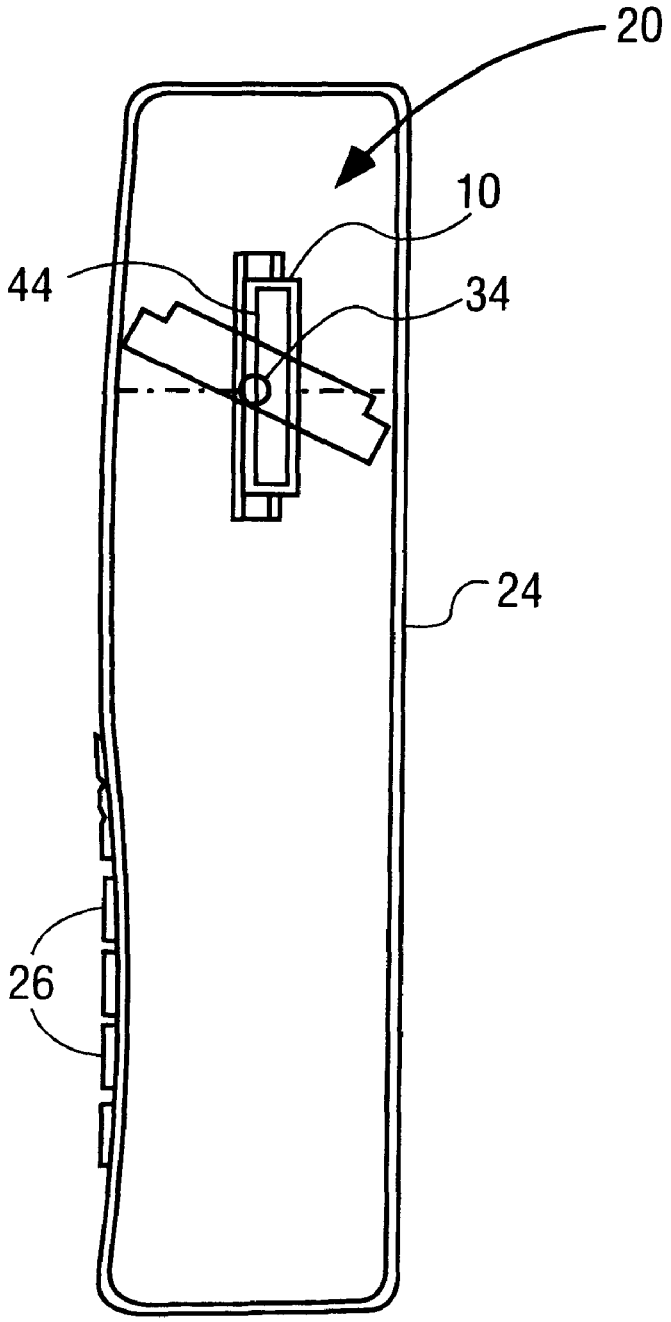
FIG. 3 is a side elevational view of the self-positioning GPS antenna incorporated into a portable device in accordance with the present invention.
Figure 4:
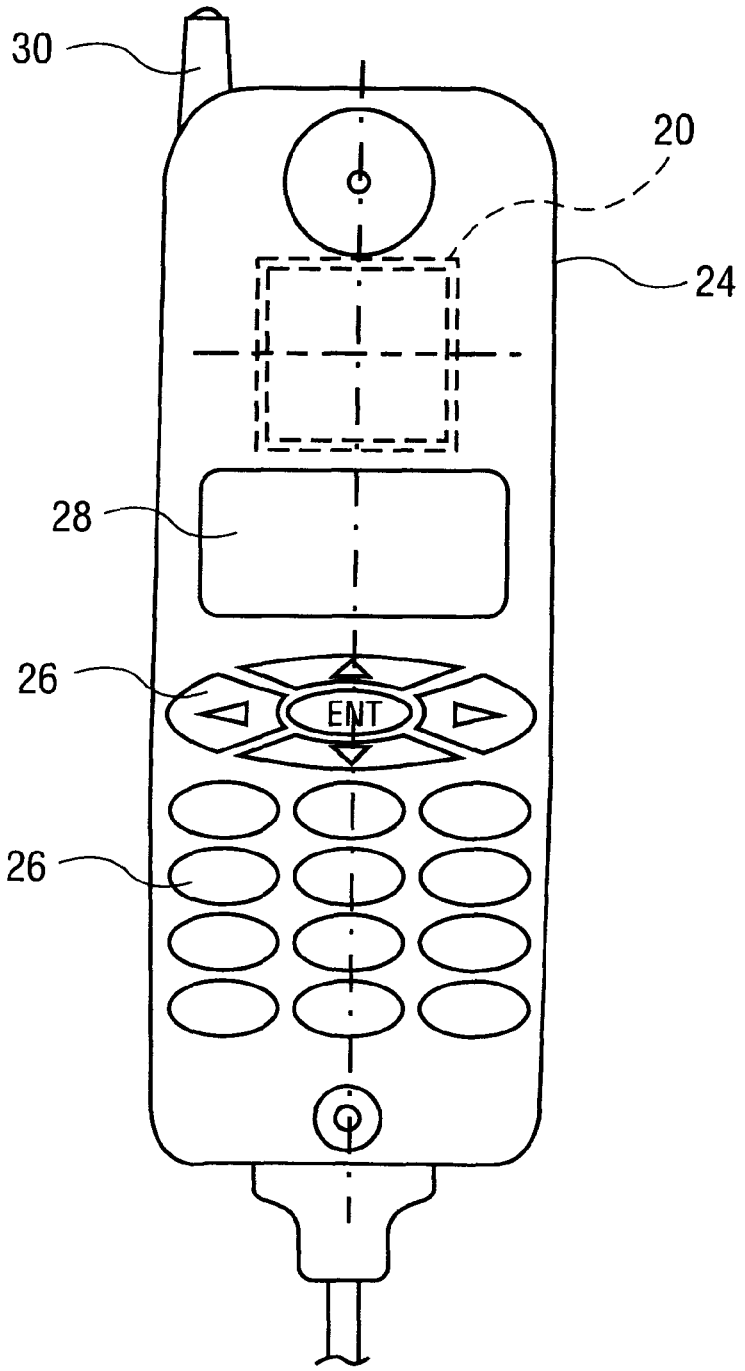
FIG. 4 is a front elevational view of a cellular phone having a self-positioning GPS antenna incorporated therein, illustrating one example of the GPS antenna location with respect to the other electronic components of the cellular phone.

In accordance with one aspect of the present invention, the self-positioning GPS antenna of the present invention is integrated into a portable electronic device. In one embodiment and as shown in FIGS. 2–4, the self-positioning GPS antenna 20 is incorporated into a cellular phone 22. The cellular phone 22 includes a housing 24, a keypad 26, a display screen 28 and a cellular antenna 30 as shown in FIG. 4. Generally, the housing 24 of a cellular phone serves to contain various cellular phone electronics including a processor, a memory, a transmitter and a receiver. The housing 24 may be constructed of plastic material in accordance with conventional portable phone chassis design. In the illustrated embodiment, the self-positioning GPS antenna 20 is contained within the interior of the cellular phone housing 24. In this regard, an empty region is provided inside the cellular phone in which the antenna holder may pivot without interference from any electronic components thereof.

According to another aspect of the invention, a pivotal connection 34 is provided between the antenna holder 10 and the cellular phone housing 24, as seen by referring to FIGS. 2 and 3. In one embodiment, the pivotal connection 34 is achieved with a pair of shafts 36 extending from the opposite sides of the antenna holder 10. These shafts 36 are in turn pivotally coupled to support members 38 affixed to the interior wall 40 of the housing 24. The shafts 36 are aligned with the intended axis of rotation of the holder 10 relative to the cellular phone 22. While the illustrated embodiment shows the self-positioning GPS antenna pivotally mounted between the side walls of the housing, it will be appreciated by those skilled in the art that the self-positioning GPS antenna may be easily modified so that it is pivotally supported between the front and rear walls of the cellular phone housing.

Also provided within the housing 24 of the cellular phone is a GPS receiver 42 which receives GPS signals detected by the antenna element 44 and based thereon computes the actual geographical location. The GPS receiver 42 may be produced in the form of a small printed circuit board suitable for use in the present invention. The GPS receiver 42 is electrically connected to the self-positioning GPS antenna 20 via a cable 46 and may be mounted to a wall of the housing. As previously mentioned, at least a portion of the holder 10 may be constructed of an electrically conductive material so as to provide electrical communication between the antenna element 44 and the cable 46. The user interface 26 (e.g., keypad, display screen, arrow keypad) of the cellular phone 22 may be configured to allow user interaction with the GPS receiver 42.

Figure 5C:
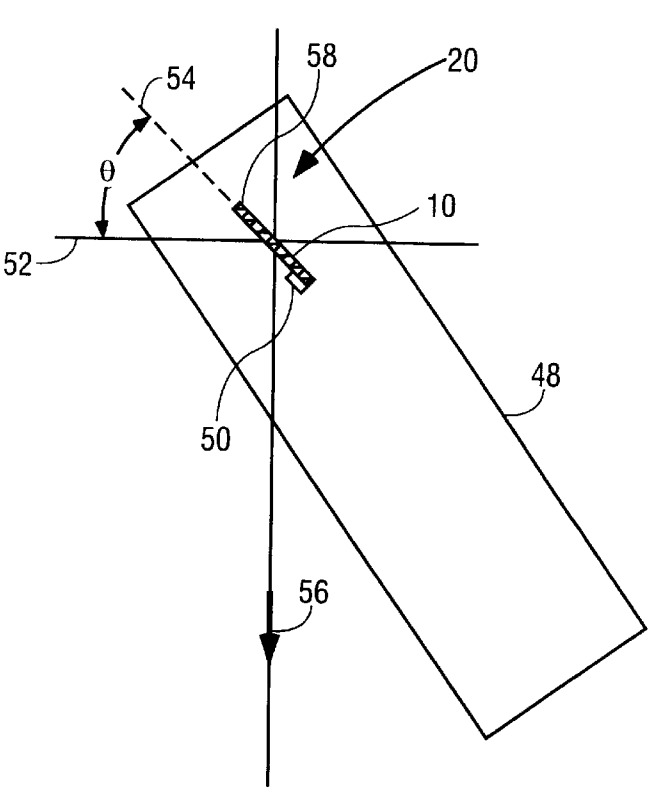
FIGS. 5A–5C are diagrams of the self-positioning GPS antenna, illustrating an antenna holder configured to maintain a predetermined angular orientation with respect to a horizontal axis.
Figure 5B:
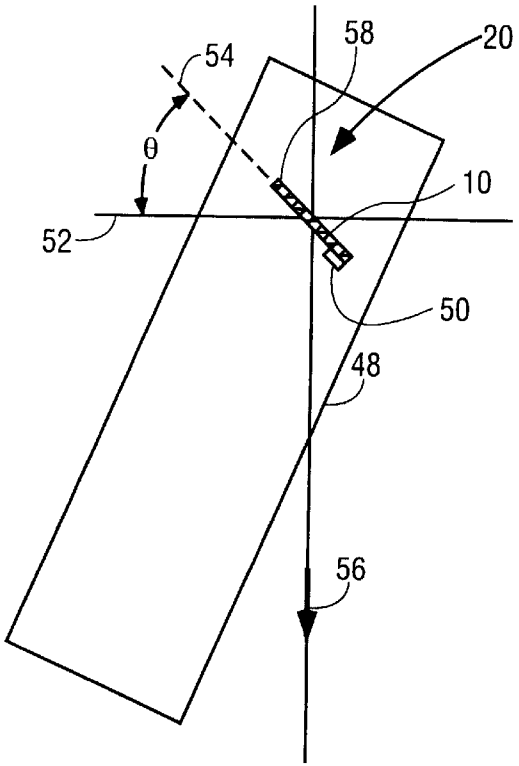
Figure 5A:
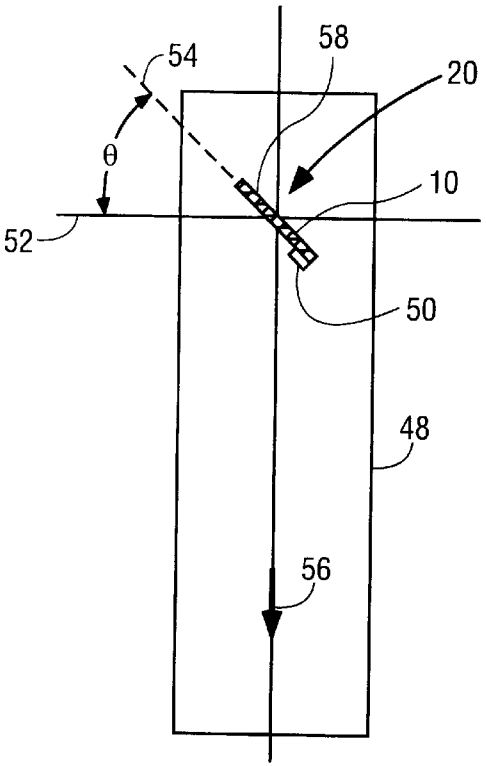

FIGS. 5A–5C show the self-positioning GPS antenna 20 of the present invention, maintaining a predetermined angular orientation with respect to a horizontal axis 52 (i.e., an axis perpendicular to the force of gravity 56). The self-positioning GPS antenna 20 is contained within the interior of a base structure 48 (e.g., portable device, vehicle). In one embodiment of the present invention, the self-positioning GPS antenna 20 is configured to maintain the face 58 of the antenna element in the range from about 5 to about 30 degrees in incline and preferably about 15 degrees incline, with respect to an axis 52 perpendicular to the force of gravity 56.

In accordance with another aspect of the present invention, the maintaining of the antenna element at a predetermined orientation is achieved by the force of gravity 56 applied to the holder 10. Because the antenna holder 10 is pivotally supported, the self-positioning GPS antenna is able to automatically readjust its orientation as the portable device becomes tilted during use. In one embodiment of the invention, extra weight 50 is applied to one side of the holder to maintain the antenna element supported by the holder at a predetermined angular orientation. The force of gravity 56 applied to the extra weight 50 on one side of the holder 10 will cause the holder and the antenna element supported thereby to be maintained at a predetermined angular orientation. In another embodiment of the invention, the placement of pivot shafts on the holder may be selected slightly displaced from a pivit axis representing the holder's center of gravity. In this regard, the weight differential of the holder when it is pivitally coupled to the base structure 48 will cause the holder to be maintained at a predetermined angular orientation. In either embodiment, the amount of weight differential will determine the angular orientation at which the self-positioning antenna will be maintained.

Although the illustrated self-positioning GPS antenna is configured to maintain an angular orientation in the range from about 5 to about 30 degrees in incline and preferably about 15 degrees incline with respect to a horizontal axis, it will be appreciated by those skilled in the art that the invention contemplates the modification of weight differential of the antenna holder to change the angle at which the antenna is maintained including substantially horizontal orientation.

According to the present invention, the self-positioning GPS antenna incorporated into a portable device provides a number of advantages. For example, a portable device user does not have to manually orient the device in order to seek an acceptable level of GPS signals, rather the antenna element is configured to automatically reorient itself to a desirable angular orientation under the influence of gravity force acting on the antenna holder.

While the foregoing embodiments of the invention have been described and shown, it is understood that variations and modifications, such as those suggested and others within the spirit and scope of the invention, may occur to those skilled in the art to which the invention pertains. The scope of the present invention accordingly is to be defined as set forth in the appended claims.

What is claimed is:

1. An apparatus for maintaining a GPS antenna element at a predetermined orientation, comprising:

an antenna holder configured to support the GPS antenna element;

a pivotal connector coupling said holder to a base structure configured to pivot said antenna holder with respect to a pivot axis, said pivot axis disposed adjacent to the antenna element; and wherein the force of gravity applied to said holder causes the holder and the GPS antenna element supported thereby to be maintained at a predetermined non-zero angle orientation with respect to the force of gravity when the base structure to which the holder is coupled changes its orientation.

2. The apparatus of claim 1, wherein said antenna holder has a center of gravity and an extra weight is provided on one side of the holder at a defined distance away from the center of gravity such that the force of gravity applied to the extra weight causes the antenna element supported by the holder to be maintained at a predetermined non-zero angle orientation with respect to the force of gravity.

3. The apparatus of claim 1, wherein the pivot axis of the holder is provided at a defined distance away from an axis intersecting the center of gravity such that weight differential causes the antenna element supported by the holder to be maintained at a predetermined non-zero angle orientation with respect to the force of gravity.

4. The apparatus of claim 1, wherein said pivotal connection comprises a pair of shafts extending from opposite sides of the holder and support members affixable to the base structure which are configured to pivotally support said shafts.

5. The apparatus of claim 1, wherein the base structure is a portable device.

6. The apparatus of claim 5, wherein the portable device is one of the following: a cellular phone and a handheld GPS navigation system.

7. The apparatus of claim 1, wherein the holder is configured to maintain one of the faces of the GPS antenna element in the range of about 5 to 30 degrees in incline with respect to an axis perpendicular to the force of gravity.

8. A self-positioning antenna comprising:

an antenna element;

a holder configured to support said antenna element, said holder pivotally attachable to a base structure and configured to pivot with respect to a pivot axis, said pivot axis disposed adjacent to said antenna element; and wherein the force of gravity applied to said holder enables the holder and said antenna element supported thereby to automatically readjust its orientation as the base structure to which the holder is attached changes its orientation such that one of the flat surfaces of the antenna element is maintained at a non-zero angle orientation with respect to the force of gravity.

9. The self-positioning antenna of claim 8, wherein said GPS antenna element has a flat planar configuration and said holder includes a frame having a receiving portion for supporting the antenna element.

10. The self-positioning antenna of claim 9, wherein the holder further comprises a pair of shafts extending from opposite sides of the frame.

11. The self-positioning antenna of claim 8, wherein said holder has a center of gravity and an extra weight is provided on one side of the holder at a defined distance away from the center of gravity such that the force of gravity applied to the extra weight causes the antenna element supported by the holder to be maintained at a predetermined non-zero angle orientation with respect to the force of gravity.

12. The self-positioning antenna of claim 8, wherein the pivot axis of the holder is provided at a defined distance away from an axis intersecting the center of gravity such that weight differential causes the antenna element supported by the holder to be maintained at a predetermined non-zero angle orientation with respect to the force of gravity.

13. A system comprising:

a base structure;

a GPS antenna element;

a GPS receiver coupled to said GPS antenna element to receive GPS signals detected by the antenna element and compute geographic location based on the GPS signals received;

a holder configured to support said GPS antenna element, said holder pivotally coupled to said base structure of said portable device and configured to pivot with respect to a pivot axis, said pivot axis disposed adjacent to the GPS antenna element; and wherein the force of gravity applied to said holder causes the holder and the GPS antenna element supported thereby to be maintained at a non-zero angle orientation with respect to the force of gravity when said base structure to which the holder is coupled changes its orientation.

14. The system of claim 13, wherein said base structure is a housing of a portable device.

15. The system of claim 13, wherein the holder further comprises a pair of shafts, said shafts are pivotally coupled to support members affixed to an interior wall of the base structure.

16. The system of claim 13, wherein said holder has a center of gravity and an extra weight is provided on one side of the holder at a defined distance away from the center of gravity such that the force of gravity applied to the extra weight causes the antenna element supported by the holder to be maintained at a predetermined non-zero angle orientation with respect to the force of gravity.

17. The system of claim 13, wherein at least a portion of the holder is constructed of an electrically conductive material.

18. The system of claim 13, wherein said base structure is a stationary structure on a vehicle.

19. The system of claim 13, wherein the pivot axis of the holder is provided at a defined distance away from an axis intersecting the center of gravity such that weight differential causes the antenna element supported by the holder to be maintained at a predetermined non-zero orientation with respect to the force of gravity.

20. An apparatus comprising:

means for supporting a flat antenna element;

means for coupling said means for supporting the antenna element to a base structure to pivot with respect to a pivot axis, said pivot axis disposed adjacent to the antenna element; and wherein the force of gravity applied to said means for supporting the antenna element causes said means for supporting the antenna element and the antenna element supported thereby to automatically readjust its orientation as the base structure changes its orientation such that one of the flat surfaces of the antenna element is maintained at a non-zero angle orientation with respect to the force of gravity.

21. The apparatus of claim 20, wherein said means for supporting the flat antenna element is an antenna holder having a center of gravity and an extra weight is provided on one side of the holder at a defined distance away from the center of gravity such that the force of gravity applied to the extra weight causes the antenna element supported by the holder to be maintained at a predetermined non-zero angle orientation with respect to the force of gravity.

22. The apparatus of claim 20, wherein said means for supporting the flat antenna element is an antenna holder and the pivot axis of the holder is provided at a defined distance away from an axis intersecting the center of gravity such that weight differential causes the antenna element supported by the holder to be maintained at a predetermined non-zero angle orientation with respect to the force of gravity.

* * * * *